US005082575A

United States Patent [19]

Yamaguchi

[11] Patent Number: 5,082,575

[45] Date of Patent: * Jan. 21, 1992

[54] METHOD FOR FIRE-EXTINGUISHMENT ON HARDLY EXTINGUISHABLE BURNING MATERIALS

[75] Inventor: Hisayoshi Yamaguchi, Tokyo, Japan

[73] Assignee: Shin-Etsu Handotai Co., Ltd., Tokyo, Japan

[ * ] Notice: The portion of the term of this patent subsequent to Nov. 7, 2006 has been disclaimed.

[21] Appl. No.: 497,422

[22] Filed: Mar. 22, 1990

Related U.S. Application Data

[63] Continuation-in-part of Ser. No. 249,316, Sep. 26, 1988, abandoned.

[51] Int. Cl.[5] ..... A62D 1/00

[52] U.S. Cl. ..... 252/2; 252/604; 106/18.12; 169/44; 169/46

[58] Field of Search ..... 252/2, 604; 169/44, 169/46; 106/18.12

[56] References Cited

U.S. PATENT DOCUMENTS

| | | | |
|---|---|---|---|
| 2,969,113 | 1/1961 | Guise | 169/1 |
| 3,055,435 | 9/1962 | Warnock | 169/31 |
| 3,393,155 | 7/1968 | Schutte et al. | 252/2 |
| 3,830,738 | 8/1974 | Cottrell | 252/4 |
| 4,008,170 | 2/1977 | Allan | 252/194 |
| 4,173,538 | 11/1979 | Herbline | 252/8 |
| 4,830,762 | 5/1989 | Yamaguchi | 252/2 |
| 4,838,946 | 6/1989 | Yamaguchi | 134/7 |
| 4,879,050 | 11/1989 | Yamaguchi | 252/2 |
| 4,915,853 | 4/1990 | Yamaguchi | 252/2 |

FOREIGN PATENT DOCUMENTS 1205136 9/1970 United Kingdom .

OTHER PUBLICATIONS

Chem. Abstr., vol. 99, No. 16, Oct. 17, 1983, p. 141. No. 125028r, JP-A-58 69 584.

Chem. Abstr., vol. 87, No. 24, Dec. 12, 1977, p. 126, Abstr. No. 186709n, SU-A-423 323.

*Primary Examiner*—Robert L. Stoll

*Assistant Examiner*—N. Bhat

*Attorney, Agent, or Firm*—McAulay Fisher Nissen Goldberg & Kiel

[57] ABSTRACT

A very efficient method is proposed for extinguishment of fire involving various dangerous materials hardly fire-extinguishable by conventional methods, such as alkali metal peroxides, alkyl aluminum compounds, diketene and calcium carbide or phosphide in contact with water. The method comprises sprinkling, over the burning site of the fire, a silica-based or silica·alumina-based powder of porous particles having a specified particle diameter and a specified pore diameter, of which the content of silicon dioxide is at least 80% by weight or the total content of silicon dioxide and aluminum oxide is at least 90% by weight. When the burning material is metallic sodium or potassium, the powder sprinkled is a blend of the above mentioned silica-based powder and a powder of sodium chloride or potassium chloride, respectively, so that the fire can be extinguished more rapidly and reliably than in the use of the silica-based powder alone.

7 Claims, No Drawings

METHOD FOR FIRE-EXTINGUISHMENT ON HARDLY EXTINGUISHABLE BURNING MATERIALS

BACKGROUND OF THE INVENTION

This is a continuation-in-part application from a copending U.S. patent application Ser. No. 07/249,316 filed Sept. 26, 1988 now abandoned.

The present invention relates to a method for extinguishing fire on a hardly extinguishable burning material or, more particularly, relates to a method for extinguishing fire on alkali metal peroxides, alkyl aluminum compounds, diketene, calcium carbide, calcium phosphide, metallic sodium and potassium and the like.

Needless to say, most of ordinary combustible materials take fire when the material is heated in the presence of oxygen and the temperature thereof has reached the so-called ignition temperature to start combustion. The most typical and versatile method for extinguishment of fire on burning materials in general is to sprinkle water, sand or a powdery fire extinguishing agent on the burning site or to blow off the flame by ejecting carbon dioxide gas. These conventional methods for fire extinguishment, however, are not applicable to the fire on the above mentioned specific dangerous materials including alkali metal peroxides, alkyl aluminum compounds, diketene, calcium carbide, calcium phosphide, metallic sodium and potassium and the like because the conventional methods of fire extinguishment not only are entirely ineffective for the purpose but also result in rather increasing the violence of the burning fire. Therefore, the use of the above mentioned conventional fire extinguishing agents must be strictly avoided in such a case. Following are the descriptions of the particular problems in the conventional fire extinguishing methods on the dangerous materials belonging to each class in connection with the combustion characteristics of the respective materials.

(1) ALKALI METAL PEROXIDES

An alkali metal peroxide such as sodium peroxide $Na_2O_2$ and potassium peroxide $K_2O_2$ is an unstable material and, when it is brought into contact with water, a violent reaction takes place between the peroxide and water to produce a large quantity of heat of reaction as well as a large volume of oxygen according to the following reaction equation given by taking sodium peroxide as an example so that the reaction proceeds explosively. Accordingly, use of water for the purpose of fire extinguishment must be strictly prohibited.

$$2Na_2O_2+2H_2O \rightarrow 4NaOH+O_2$$

Further, alkali metal peroxides are decomposed also in contact with an organic material to promote combustion of the organic material so that, at any rate, alkali metal peroxideds must be handled with utmost care.

In the extinguishment of fire on an alkali metal peroxide having the above mentioned reactivity, not only water as a matter of course but also other conventional fire extinguishing agents, e.g., ammonium phosphate powders, carbon dioxide gas, Halons and the like, cannot be used because these materials also may react with the alkali metal peroxide. Barely dry sand may serve for the purpose when the burning site can be completely covered therewith although complete fire extinguishment is a rather difficult matter. It should be noted also that it is an extremely difficult matter in practice to maintain a large stockpile of sand in a completely dry condition to prepare for a fire in a large scale.

(2) ALKYL ALUMINUM COMPOUNDS

An alkyl aluminum compound, such as trimethyl aluminum $(CH_3)_3Al$, triethyl aluminum $(C_2H_5)_3Al$, triisopropyl aluminum $(iC_3H_7)_3Al$ and the like, is a colorless liquid and spontaneously takes fire when it is contacted with air. The reaction equations for the combustion of trimethyl aluminum $(CH_3)_3Al$ and triethyl aluminum $(C_2H_5)_3Al$ are as follows.

$$2(CH_3)_3Al+12O_2 \rightarrow 6CO_2+Al_2O_3+9H_2O$$

$$2(C_2H_5)_3Al+21O_2 \rightarrow 12CO_2+Al_2O_3+15H_2O$$

Alkyl aluminum compounds are also highly reactive when they are in contact with water to cause an explosive decomposition reaction according to the following reaction equations taking trimethyl aluminum and triethyl aluminum as the examples.

$$(CH_3)_3Al+3H_2O \rightarrow Al(OH)_3+3CH_4$$

$$(C_2H_5)_3Al+3H_2O \rightarrow Al(OH)_3+3C_2H_6$$

They also react violently with alcoholic compounds.

When an alkyl aluminum compound has been set on fire, the fire can be extinguised with extreme difficulties by any of known methods of fire extinguishment. Namely, water or a water-containing fire extinguishing agent must not be used absolutely as is readily understood from the above given description of the reactivity of the compound. Further, carbon dioxide gas and Halons also cannot be used due to the reactivity thereof with the burning alkyl aluminum compound. Powdery fire extinguishing agents such as ammonium phosphate are also ineffective. The only measure to be undertaken is to sprinkle a large volume of dry sand over the burning site to suppress the violence of fire watching and awaiting exhaustion of the burning liquid under suppressed violence of fire.

(3) DIKETENE

Diketene $C_4H_4O_2$ is widely used as an important intermediate in the synthesis of acetoacetic acid esters, acetoacetic acid anilide, and various kinds of medicines, dyes, germicides and antiseptics as well as other industrial chemicals. This compound is a liquid having a boiling point at 127.4° C. and a low flash point at 35° C. so that a slight increase in the temperature involves a danger of fire taking place in air. The compound burns violently at an elevated temperature or under a superatmospheric pressure according to the following reaction equation.

$$C_4H_4O_2+4O_2 \rightarrow 4CO_2+2H_2O$$

Diketene in itself has an intensely irritative malodor and is a strong lacrimator always involving a danger to cause a secondary disaster. It is insoluble in water so that a fire on burning diketene can hardly be extinguished by sprinkling water which results in merely enlarging the burning site. Conventional powdery fire extinguishing agents cannot be used against the fire on diketene because of the possible reaction between them.

(4) CALCIUM CARBIDE AND CALCIUM PHOSPHIDE

As is well known, calcium carbide and water violently react to produce acetylene according to the following reaction equation.

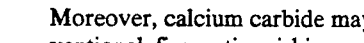

$$CaC_2+2H_2O \rightarrow C_2H_2+Ca(OH)_2$$

Acetylene gas readily takes fire and explosively burns when it is mixed with air in the presence of a fire source so that calcium carbide must be kept away from water. Moreover, calcium carbide may react with certain conventional fire extinguishing agents other than water. Dry sand barely provides a means for extinguishment but no sufficient effect of fire extinguishment can be expected for the same reasons as in the fire extinguishment on alkyl aluminum compounds.

Calcium phosphide also reacts with water or moisture according to the following reaction equation to produce phosphine which may spontaneously take fire when it is mixed with air so that the fire may spread over any combustible materials in the vicinity.

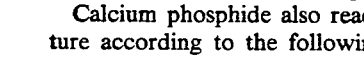

$$Ca_3P_2+6H_2O \rightarrow 2PH_3+3Ca(OH)_2$$

Thus, water can never be used also for extinguishment of fire on calcium phosphide. Conventional known fire extinguishing agents are also not applicable. Dry sand is barely applicable thereto although sufficient effects of fire extinguishment can hardly be obtained therewith.

(5) METALLIC SODIUM AND POTASSIUM

When metallic sodium or potassium is brought into contact with water, a violent reaction takes place therebetween according to the following reaction equations to generate a large quantity of heat and hydrogen gas.

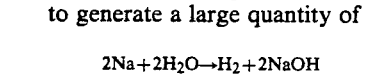

$$2Na+2H_2O \rightarrow H_2+2NaOH$$

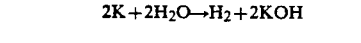

$$2K+2H_2O \rightarrow H_2+2KOH$$

Once set on fire, these alkali metals continue burning in air according to the following reaction equations.

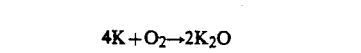

$$4Na+O_2 \rightarrow 2Na_2O$$

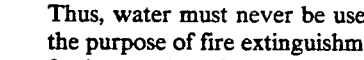

$$4K+O_2 \rightarrow 2K_2O$$

Thus, water must never be used on an alkali metal for the purpose of fire extinguishment due to not only ineffectiveness but also a great increase in danger of fire. Carbon dioxide gas also reacts with an alkali metal so that the gas cannot be used as a fire extinguishing agent. Further, sufficient effects of fire extinguishment on alkali metals can not be obtained by using certain powdery fire extinguishing agents containing sodium chloride or sodium carbonate as the principal ingredient.

Thus, it is eagerly desired to develop a novel and efficient method for fire extinguishment free from the above described problems and disadvantages when a dangerous material belonging to either one of the above described five classes has been set on fire.

SUMMARY OF THE INVENTION

The present invention accordingly has an object to provide a novel and efficient method for extinguishment of fire on a dangerous material belonging to either one of the above described classes.

Thus, the method provided by the invention for extinguishment of fire on a dangerous material selected from the group consisting of alkali metal peroxides, alkyl aluminum compounds, diketene, calcium carbide and calcium phosphide comprises: sprinkling, over the burning site of the fire, a silica-based powder of porous particles containing at least 80% by weight of silica or a silica.alumina-based powder of porous particles containing at least 90% by weight of silica and alumina as a total, of which the porous particles have a particle diameter in the range from 5 μm to 5 mm, an apparent density in the range from 0.2 to 0.7 g/cm$^3$ and a pore diameter in the range from 0.1 to 100 μm.

Further, the invention provides a method for extinguishment of fire on metallic sodium or metallic potassium which comprises: sprinkling, over the burning site of the fire, a powdery mixture of a silica-based powder of porous particles containing at least 80% by weight of silica, of which the porous particles have a particle diameter in the range from 5 μm to 5 mm, an apparent density in the range from 0.2 to 0.7 g/cm$^3$ and a pore diameter in the range from 0.1 to 100 μm, with admixture of a powder of an alkali metal chloride which is sodium chloride or potassium chloride when the burning alkali metal is sodium or potassium, respectively.

The effectiveness of the above defined method of fire extinguishment can be further enhanced when the silica-based or silica.alumina-based powder of porous particles and/or the powdery sodium or potassium chloride is treated with an organosilane compound or an organopolysiloxane compound so as to be rendered hydrophobic on the surface of the particles.

DETAILED DESCRIPTION OF THE PREFERRED EMBODIMENTS

As is known, the works of fire extinguishment in general are performed relying on four different mechanisms for extinguishment including:

(1) the removing effect which means that the fire is ceased when the combustible material is removed from the burning site;

(2) the suffocating effect which means that the burning site is shielded from the access of air or oxygen which supports burning of the combustible material;

(3) the cooling effect which means that combustion of a combustible material is suppressed or discontinued when the heat of combustion is absorbed from or removed out of the burning system so as to decrease the temperature of the burning material below the ignition point thereof; and (4) the suppressing effect which means that the chain-like reaction of combustion is interrupted so as to retard propagation of fire.

Naturally, fire extinguishing works in general mostly rely not on only one but on a combination of two or more of these principles so as to obtain a synergistic effect. The method of the invention also has been developed from the standpoint of obtaining an exquisite synergistic effect of these four different principles.

In the first aspect of the inventive method directed to extinguishment of fire on a dangerous material selected from the group consisting of alkali metal peroxides, alkyl aluminum compounds, diketene, calcium carbide and calcium phosphide, the fire extinguishing agent sprinkled over the burning site of the fire is a specific silica-based powder or silica.alumina-based powder. The silica-based powder contains at least 80% by weight of silica and has the properties specified above. Such a specific silica-based powder can be obtained from a natural amorphous siliceous sand occurring in the Itoigawa district, Niigata Prefecture, Japan and supplied under a tradename of Silton 3S. To be more suitable for use in the inventive method, the sand of Silton 3S as supplied is mulled with water, dried and calcined and, after a treatment with hydrochloric acid, again dried and subjected to screening for particle size classification. The thus prepared powder is insoluble in acids and alkalis and typically has a true density of 2.3 $g/cm^3$, apparent density of 0.55 $g/cm^3$ and porosity of 70% and contains about 89.1% by weight of silica.

Another fire extinguishing agent used in the inventive method alternatively to the above described silica-based powder is a silca.alumina-based powder having the above specified properties. The powder should contain at least 90% by weight of silica and alumina as a total. Such a silica.alumina-based powder of porous particles can be prepared, for example, by blending the above mentioned Silton 3S with kaolin, mulling the powdery blend with water, drying, calcining, pulverizing and screening. This powder is also insoluble in acids and alkalis and typically has a true density of 2.5 $g/cm^3$, apparent density of 0.45 $g/cm^3$ and porosity of 80% and contains about 68% by weight of silica and 23% by weight of alumina to give 91% by weight of a total of these two constituents.

It is important that the particles of the above described powders have a particle diameter of at least 5 μm or, preferably, in the range from 5 μm to 5 mm. A powder having a particle diameter not exceeding 200 μm is suitable for use as a filling in fire-extinguishers to be ejected with a pressurized gas while a powder having a particle diameter exceeding 200 μm is suitable for sprinkling by using shovels, buckets and the like. A powder having a particle diameter smaller than 5 μm or having an apparent density smaller than 0.2 $g/cm^3$ is not suitable for use in the inventive method since the powder as sprinkled over the burning site of fire is readily blown off and scattered away by the violence of the fire.

The powder of porous particles should have a pore diameter in the range from 0.1 to 100 μm. In this regard, conventional silica gels, alumina gels and silica.alumina gels cannot be used in the inventive method since the pores in these gel materials distribute only in the surface layer of the particles and the pore diameter therein is so fine as to be 0.1 μm or smaller exhibiting a so large surface area available for the adsorption of a burning liquid material such as the alkyl aluminum compounds and diketene as the objective dangerous material in the inventive method resulting in evolution of a large quantity of heat of adsorption leading to an increase in the temperature rather to increase the difficulty in fire extinguishment.

Besides the above mentioned limitation in the purity of the powder relative to the content of silica and/or alumina, it is of course important that the powdery material used in the inventive method has a purity as high as possible or contains impurities which may react with the burning dangerous materials in an amount as small as possible. Such undesirable impurities include, for example, iron oxide $Fe_2O_3$, calcium oxide CaO, magnesium oxide MgO, potassium oxide $K_2O$, sodium silicate $xNa_2O.ySiO_2$ and the like originating in the starting raw materials. Needless to say, these powders should be dry as completely as possible so that the powders as prepared must be fully dried and stored under a hermetically sealed condition to exclude atmospheric moisture.

The sodium or potassium chloride powder admixed in the powdery fire extinguishing agent used in the extinguishing works of fire on burning metallic sodium or potassium, respectively, as an auxiliary constituent should have a purity of at least 99% and a particle diameter in the range from 1 μm to 200 μm. It is of course that the sodium or potassium chloride powder must be as dry as possible.

It is advantageous that the powdery constituents of the fire extinguishing agent used in the inventive method, i.e. the silica-based or silica.alumina-based powder of porous particles and/or the powdery sodium or potassium chloride, are surface-treated, in particular, when the powder is used as a filling of fire extinguishers with an organosilicon compound such as organochlorosilanes, e.g., methyl chlorosilanes and derivatives thereof, or organopolysiloxanes, e.g., methyl hydrogen polysiloxanes and derivatives thereof, so as to be rendered hydrophobic on the surface resulting in a decrease in the moisture absorption and improvement in the free-flowing characteristic as a powder.

When the above described powdery fire extinguishing agent is sprinkled over the burning site on the various dangerous combustible materials in such an amount that the burning material is covered up with a layer of the powder, a rapid and reliable effect of fire extinguishment can be achieved. When the burning material is an alkali metal peroxide, calcium carbide or calcium phosphide, for example, absolutely no chemical changes take place in the silica-based or silica.alumina-based powder of porous particles sprinkled according to the first aspect of the inventive method due to the non-reactivity thereof with the burning material and incombustibility in itself. Even though no chemical changes take place in the sprinkled powder, the burning material is shielded from the access of the atmospheric air by the layer of the powder entirely covering the burning site so that the fire can be rapidly and reliably extinguished by the suffocating effect as a result of shielding from the oxygen supply.

The behavior of the powdery fire extinguishing agent sprinkled according to the first aspect of the inventive method is somewhat different when the burning material is a liquid such as alkyl aluminum compounds and diketene. Although no chemical changes take place in the silica-based or silica.alumina-based porous powder due to the non-reactivity thereof with the burning material and high heat resistance and incombustibility in itself, the burning liquid is rapidly absorbed in the numberless pores of the porous particles so that the removing effect can be exhibited. The suffocating effect can of course be exhibited in just the same manner as in the extinguishment of fire on the alkali metal peroxide and the like mentioned above.

The fire on metallic sodium or potassium can be extinguished more efficiently by the inventive method according to the second aspect in which the powdery fire extinguishment agent is a blend of the silica-based porous powder as the principal constituent and a powder of an alkali metal chloride such as sodium and potassium chlorides as the auxiliary constituent. Preferably, the alkali metal chloride is sodium chloride or potaddium chloride when the burning alkali metal is sodium or potassium, respectively. Namely, the silica contained in the sprinkled powder may react with the sodium or potassium oxide as the product formed by burning of the alkali metal to form sodium or potassium silicate according to the following reaction equations.

$$Na_2O + SiO_2 \rightarrow Na_2SiO_3$$

$$K_2O + SiO_2 \rightarrow K_2SiO_3$$

Sodium or potassium silicate has a relatively low melting point and is readily melted and converted into a glassy form which covers the burning site of the alkali metal to exhibit the suffocating effect. It is noted that the particularly fine particles in the silica-based porous powder may act to temporarily enhance the violence of the flame on the burning alkali metal. However, this rather undesirable effect can be compensated for by the admixture of a powder of sodium chloride, when the burning metal is sodium, or potassium chloride, when the burning metal is potassium, in the powdery fire extinguishing agent. Namely, sodium or potassium chloride exposed to the flame at a high temperature is decomposed to form sodium or potassium ions, $Na^+$ or $K^+$, which act as a negative catalyst to retard the burning of the alkali metal, i.e. sodium or potassium, so that the flame can be efficiently suppressed. Incidentally, sodium and potassium chlorides are absolutely non-reactive with metallic sodium and/or potassium. Thus, a synergistic effect is exhibited by sprinkling the composite powdery fire extinguishing agent according to the second aspect of the inventive method on the burning alkali metals as a combination of the suffocating effect by the glassy crust layer of the alkali silicate as a reaction product of the silica and the combustion product of the alkali metal and the suppressing effect by the sodium or potassium ions.

The metallic sodium or potassium in the burning site is of course in a molten state. Although the molten sodium and potassium has a small density of 0.85 and 0.72 g/cm$^3$, respectively, at 500° C., the silica-based porous powder as the principal constituent of the powdery fire extinguishment agent used in the inventive method has an apparent density of 0.2 to 0.7 g/cm$^3$ so that the particles never sink into but float on the molten alkali metal to fully exhibit the effect of fire extinguishment.

In the following, the method of fire extinguishment according to the invention is described in more detail by way of examples.

EXAMPLE 1

A cloth soaked with 5 ml of kerosene was spread on a stainless steel-made dish of 30 cm diameter and 50 g of sodium peroxide $Na_2O_2$ were put thereon. The cloth wet with kerosene was set on fire. When heated at a high temperature, the sodium peroxide was burnt violently with orange flames. Thereafter, the fire was extinguished by sprinkling one of different fire extinguishing agents including:

(i) a silica-based porous powder having a particle diameter distribution in the range from 5 μm to 500 μm and a pore diameter distribution in the range from 0.1 μm to 10 μm, referred to as the powder A hereinbelow;

(ii) a silica.alumina-based porous powder having a particle diameter distribution in the range from 50 μm to 5000 μm and a pore diameter distribution in the range from 0.2 μm to 100 μm, referred to as the powder B hereinbelow; and (iii) conventional dry sand, referred to as the powder C hereinbelow.

Table 1 below shows the amount of the fire extinguishing powder in g required for complete extinguishment of the fire and the time in seconds taken until complete extinguishment.

TABLE 1

| Powder | Amount of powder, g | Time taken for extinguishment, seconds |
|---|---|---|
| A | 150 | 10 |
| B | 180 | 12 |
| C | 780 | 30 |

As is understood from the results shown above, only one fourth to one fifth amount of the powdery fire extinguishing agent as compared with the conventional dry sand is sufficient according to the inventive method and the time taken for complete extinguishment can also be greatly decreased.

EXAMPLE 2.

The testing procedure was substantially the same as in Example 1 except that sodium peroxide was replaced with the same amount of potassium peroxide $K_2O_2$.

Table 2 below shows the amount of the fire extinguishing powder in g required for complete extinguishment of the fire and the time in seconds taken until complete extinguishment.

TABLE 2

| Powder | Amount of powder, g | Time taken for extinguishment, seconds |
|---|---|---|
| A | 100 | 8 |
| B | 130 | 10 |
| C | 580 | 25 |

As is understood from the results shown above, only one fourth to one fifth amount of the powdery fire extinguishing agent as compared with the conventional dry sand is sufficient according to the inventive method and the time taken for complete extinguishment can also be greatly decreased.

EXAMPLE 3.

As a preliminary test, 30 ml of trimethyl aluminum $(CH_3)_3Al$ were taken in a metal-made vessel and left standing there until spontaneous combustion took place. The fire could easily be extinguished by sprinkling 40 g of a silica-based porous powder having a particle diameter distribution in the range from 50 to 1000 μm and pore diameter distribution in the range from 0.2 to 100 μm over the fire. Then, a blend of 50 ml of trimethyl aluminum and 50 ml of liquid paraffin was taken in the same metal-made vessel as above and left standing until spontaneous combustion took place. The fire also could be readily extinguished within 60 seconds by sprinkling 30 g of the same silica-based porous powder as above over the burning site.

On the other hand, the fire in a similar test for comparison failed to be extinguished by sprinkling 520 g of the same dry sand as used in Examples 1 and 2.

EXAMPLE 4.

A 50 ml portion of triethyl aluminum $(C_2H_5)_3Al$ was taken in a metal-made vessel and left standing there until spontaneous combustion took place. The fire could easily be extinguished within 70 seconds by sprinkling 100 g of a silic.alumina-based porous powder having a particle diameter distribution in the range from 20 μm to 2000 μm, pore diameter distribution in the range from 0.2 μm to 100 μm and apparent density of 0.45 g/cm$^3$ over the fire.

For comparison, 550 g of dry sand were sprinkled over the burning site of triethyl aluminum to fill up the metal-made vessel without success in extinguishing the fire.

As is understood from the above given Examples 3 and 4, the method of the present invention is very effective in rapidly extinguishing the fire on alkyl aluminum compounds which can hardly be extinguished with any conventional fire extinguishing agents. It should be noted that the trimethyl aluminum and triethyl aluminum used in these examples are notorious in the difficulty of fire extinguishment among alkyl aluminum compounds and the fire on other alkyl aluminum compounds of which the alkyl groups have three or more carbon atoms can be more easily and rapidly extinguished according to the inventive method. The inventive method is of course applicable to extinguishment of the fire on alkyl indium compounds, alkyl gallium compounds and the like having less combustibility than alkyl aluminum compounds.

EXAMPLE 5.

A 50 ml portion of diketene was taken in a small stainless steel-made vessel and set on fire. After allowing the diketene for burning for 20 seconds, 40 g of a silica-based porous powder having a particle diameter distribution in the range from 5 μm to 500 μm and pore diameter distribution in the range from 0.1 μm to 10 μm were sprinkled over the burning diketene so that the fire could be extinguished within 15 seconds without causing any boiling noise. The temperature of the diketene left in the vessel had been increased only to 55° C.

For comparison, the same test as above was repeated by using dry sand in place of the silica-based porous powder. The fire could be extinguished after 25 seconds when 270 g of the sand had been sprinkled. A noise of boiling was heard during this procedure. The temperature of the diketene left in the vessel had been increased to 60.5° C.

EXAMPLE 6.

A stainless steel-made vessel having an inner diameter of 10 cm and a depth of 6 cm was charged with 50 g of calcium carbide to which 30 ml of water were poured to evolve acetylene gas. After 20 seconds of uncontrolled burning of the acetylene gas by ignition, a powdery fire extinguishing agent, which was one of the powders A, B and C used in Examples 1 and 2, was sprinkled over the burning site using a metal-made spoon to extinguish the fire. The results of these fire extinguishment tests were as shown in Table 3 below.

TABLE 3

| Powder | Amount of powder, g | Time taken for extinguishment, seconds | Remarks |
|---|---|---|---|
| A | 100 | 30 | easily extinguished |
| B | 120 | 35 | |
| C | 650 | — | not extinguished after 90 seconds |

As is understood from the results shown above, the method of the present invention is very effective for extinguishing the fire of acetylene gas evolved from calcium carbide while conventional sand is quite ineffective for the purpose.

EXAMPLE 7.

The same experimental procedure as above was repeated except that the calcium carbide was replaced with the same amount of calcium phosphide and the evolved gas by pouring water was naturally not acetylene but phosphine gas. The results of the fire extinguishment tests are shown in Table 4 given below.

TABLE 4

| Powder | Amount of powder, g | Time taken for extinguishment, seconds |
|---|---|---|
| A | 80 | 15 |
| B | 100 | 20 |
| C | 550 | 30 |

As is understood from the results shown above, the method of the present invention is very effective for extinguishing the fire of phosphine gas evolved from calcium phosphide while conventional sand is quite ineffective for the purpose.

EXAMPLE 8.

Sticks of metallic sodium weighing 50 g were put on a stainless steel-made frying pan having a diameter of 20 cm and heated from below with a gas burner so that the metallic sodium was melted and spontaneously ignited. At a moment when the temperature of the molten and burning metallic sodium had just reached 550° C., a powdery fire extinguishing agent was sprinkled over the burning metallic sodium so that the fire could be extinguished. The sprinkled powder was either a silica-based powder of porouns particles having a particle diameter distribution in the range from 10 μm to 200 μm or a blend of the same with a powder of sodium chloride. Table 5 given below shows the mixing ratio of the silica powder and the sodium chloride powder by weight ($SiO_2$:NaCl), and the amount of the powder used for complete extinguishment of the fire as well as the notes relative to the enhancement of the flame, other remarks, if any, and overall evaluation of the effectiveness of the method given in four ratings of: A for excellent effectiveness; B for good effectiveness; C for fair effectiveness; and D for poor effectiveness.

As is understood from the results shown in Table 5, the effectiveness of fire extinguishment according to the inventive method is more remarkable when the powdery fire extinguishing agent is a blend of the silica-based powder and sodium chloride powder according to the second aspect of the invention when the burning material is an alkasli metal in respect of suppression of the flames. Moreover, a hard crust is formed to cover the burning site of the fire when the powder blend contains a suitable amount of sodium chloride powder so as to further enhance the effectiveness of fire extinguishment. In this regard, the powdery mixture should contain from 10% to 40% by weight of the sodium chloride powder.

For comparative purpose, the same fire extinguishment test was conducted by using conventional dry sand as the fire extinguishing agent. The result was that, by using a considerably large amount of the dry sand, not only the fire could not be extinguished but high flames were raised with bursting noises and sparks.

TABLE 5

| $SiO_2$: NaCl | Amount of powder used, g | Flame enhancement | Other remarks | Overall evaluation |
|---|---|---|---|---|
| 10:0 | 80 | intens | | C |
| 9:1 | 96 | little | | B |
| 8:2 | 95 | very little | hard crust formed after extinguishment | A |
| 7:3 | 90 | no | hard crust formed after extinguishment | A |
| 6:4 | 100 | no | | B |
| 5:5 | 100 | no | noise heard | C |

EXAMPLE 9.

The procedure of the fire extinguishment test was substantially the same as in Example 8 except that the metallic sodium was replaced with the same amount of metallic potassium and the powdery fire extinguishment agent was sprinkled when the temperature of the molten potassium metal had reached 500° C. The results of the tests were as shown in Table 6 below.

TABLE 6

| $SiO_2$: KCl | Amount of powder used, g | Flame enhancement | Other remarks | Overall evaluation |
|---|---|---|---|---|
| 10:0 | 70 | intense | | D |
| 9:1 | 76 | a little | | C |
| 8:2 | 86 | very little | hard crust formed after extinguishment | B |
| 7:3 | 82 | very little | hard crust formed after extinguishment | B |
| 5:5 | 87 | noticeable with sparks | | C |
| (dry sand) | 650 | very remarkable | bursting noise with sparks | D |

As is understood from the results shown in Table 6, the effectiveness of fire extinguishment according to the inventuive method is more remarkable when the powdery fire extinguishing agent is a blend of the silica-based powder and potassium chloride powder according to the second aspect of the invention when the burning material is metallic potassium in respect of suppression of the flames. Moreover, a hard crust is formed to cover the burning site of the fire when the powder blend contains a suitable amount of potassium chloride powder so as to further enhance the effectiveness of fire extinguishment. The flame-suppressing effect obtained by using the powder blend of the silica-based powder and potassium chloride powder is noticeable when the amount of the potassium chloride powder is 10% by weight or larger in the powder blend and most remarkable when the content thereof is 30 to 40% by weight while an increase thereof over 50% by weight is undesirable because the flames are rather enhanced with sparks by sprinkling the powder blend.

For comparative purpose, the same fire extinguishment test was conducted by using conventional dry sand as the fire extinguishing agent. Even by using a considerably large amount of the dry sand, not only the fire could not be extinguished but high flames were raised with cracking noises and sparks. It should also be noted that dry sand has a density of approximately 2.5 g/cm$^3$ which is much larger than that of molten metallic potassium so that the sand particles as sprinkled readily sink into molten potassium and the fire naturally cannot by extinguished unless the amount of the sprinkled sand is impractically large.

What is claimed is:

1. A method for extinguishment of fire on a hardly fire-extinguishable material selected from the group consisting of alkali metal peroxides, alkyl aluminum compounds, diketene, calcium carbide and calcium phosphide which comprises:

sprinkling, over the burning site of the fire, a silica-based powder of porous particles containing at least 80% by weight of silica or a silica.alumina-based powder of porous particles containing at least 90% by weight of silica and alumina as a total, of which the porous particles have a particle diameter in the range from 5 μm to 5 mm, an apparent density in the range from 0.2 g/cm$^3$ to 0.7 g/cm$^3$ and a pore diameter in the range from 0.1 μm to 100 μm.

2. A method for extinguishment of fire on a burning alkali metal which comprises:

sprinkling, over the burning site of the fire, a powdery mixture of a silica-based powder of porous particles containing at least 80% by weight of silica, of which the porous particles have a particle diameter in the range from 5 μm to 5 mm, an apparent density in the range from 0.2 g/cm$^3$ to 0.7 g/cm$^3$ and a pore diameter in the range from 0.1 μm to 100 μm, with admixture of a powder of an alkali metal chloride of which the alkali metal element is the same as the burning alkali metal.

3. The method for extinguishment of fire on an alkali metal as claimed in claim 2 wherein the burning alkali metal is sodium and the alkali metal chloride is sodium chloride.

4. The method for extinguishment of fire on an alkali metal as claimed in claim 2 wherein the burning alkali metal is potassium and the alkali metal chloride is potassium chloride.

5. The method for extinguishment of fire as claimed in claim 1 wherein the powder has a surface rendered hydrophobic by a treatment with an organosilane compound or an organopolysiloxane compound.

6. The method for extinguishment of fire as claimed in claim 2 wherein the powders have a surface rendered hydrophobic by a treatment with an organosilane compound or an organopolysiloxane compound.

7. The method for extinguishment of fire as claimed in claim 2 wherein the silica-based powder of porous particles and the alkali metal chloride powder are mixed in a proportion in the range from 90:10 to 60:40 by weight.

* * * * *

UNITED STATES PATENT AND TRADEMARK OFFICE

CERTIFICATE OF CORRECTION

PATENT NO. : 5,082,575

DATED : January 21, 1992

INVENTOR(S) : Hisayoshi Yamaguchi

It is certified that error appears in the above-identified patent and that said Letters Patent is hereby corrected as shown below:

On Title page insert, item

[30] Foreign Application Priority Data

Sept. 29, 1987 [JP] Japan - 62-244828

Signed and Sealed this

Thirteenth Day of July, 1993

*Attest:*

Michael K. Kirk

MICHAEL K. KIRK

*Attesting Officer*

*Acting Commissioner of Patents and Trademarks*